US008276405B2

(12) United States Patent
Ogata

(10) Patent No.: US 8,276,405 B2
(45) Date of Patent: Oct. 2, 2012

(54) KNITTED FABRIC AND SPORTS CLOTHING

(75) Inventor: Nobuaki Ogata, Osaka (JP)

(73) Assignee: Teijin Fibers Limited, Osaka (JP)

( * ) Notice: Subject to any disclaimer, the term of this patent is extended or adjusted under 35 U.S.C. 154(b) by 292 days.

(21) Appl. No.: 12/306,667

(22) PCT Filed: Jun. 25, 2007

(86) PCT No.: PCT/JP2007/063184

§ 371 (c)(1),
(2), (4) Date: Dec. 24, 2008

(87) PCT Pub. No.: WO2008/001920

PCT Pub. Date: Jan. 3, 2008

(65) Prior Publication Data

US 2009/0308107 A1 Dec. 17, 2009

(30) Foreign Application Priority Data

Jun. 28, 2006 (JP) ..... 2006-177710

(51) Int. Cl.
*D04B 1/24* (2006.01)

(52) U.S. Cl. ..... 66/171; 66/202

(58) Field of Classification Search ..... 57/236, 57/237, 238, 239; 66/202, 169 R, 170, 171
See application file for complete search history.

(56) References Cited

U.S. PATENT DOCUMENTS

| | | | | | |
|---|---|---|---|---|---|
| 2,564,245 | A | * | 8/1951 | Billion | 57/292 |
| 3,583,147 | A | * | 6/1971 | Brizzolara et al. | 57/245 |
| 3,586,147 | A | * | 6/1971 | Hoffman | 400/338.2 |
| 3,879,928 | A | * | 4/1975 | Usdan | 57/247 |
| 4,074,511 | A | * | 2/1978 | Chambley et al. | 57/293 |
| RE29,572 | E | * | 3/1978 | Usdan | 57/247 |
| 4,123,893 | A | * | 11/1978 | Chambley et al. | 57/204 |
| 6,886,369 | B2 | * | 5/2005 | Fukuro et al. | 66/202 |
| 7,288,306 | B2 | * | 10/2007 | Kersey | 57/236 |
| 7,520,121 | B2 | * | 4/2009 | Teshima et al. | 57/236 |

FOREIGN PATENT DOCUMENTS

| | | | | |
|---|---|---|---|---|
| EP | 1006227 | A1 | | 6/2000 |
| GB | 2022154 | A | * | 12/1979 |
| JP | 5-148734 | A | | 6/1993 |
| JP | 5-247760 | A | | 9/1993 |
| JP | 2000-282344 | A | | 10/2000 |
| JP | 2000-282345 | A | | 10/2000 |
| JP | 2002030548 | A | | 1/2002 |
| JP | 2003-166136 | A | | 6/2003 |
| JP | 2003247149 | A | | 9/2003 |
| JP | 2003-306838 | A | | 10/2003 |
| JP | 2004-339654 | A | | 12/2004 |
| JP | 3749549 | B2 | | 3/2006 |

* cited by examiner

*Primary Examiner* — Danny Worrell
(74) *Attorney, Agent, or Firm* — Sughrue Mion, PLLC

(57) ABSTRACT

A knitted fabric containing a composite yarn is provided, which is characterized in that the composite yarn is constituted of two or more kinds of false-twist crimped yarns and has a torque of not more than 30 T/m.

16 Claims, 1 Drawing Sheet

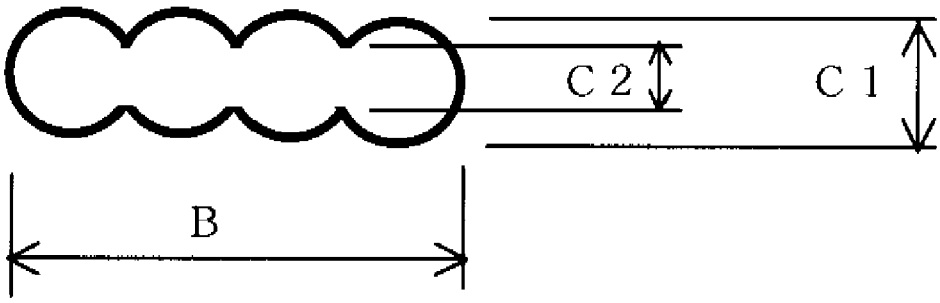
C 2
C 1
B

KNITTED FABRIC AND SPORTS CLOTHING

TECHNICAL FIELD

The present invention relates to a knitted fabric having excellent snagging resistance without impairing soft touch and stretchability which are characteristic features of a knitted fabric and to sports clothing comprising using such a knitted fabric.

BACKGROUND ART

Since a knitted fabric has excellent characteristic features such as soft touch and stretchability, it is used for various clothing applications including sport clothing and inner lingerie. However, the knitted fabric has such excellent characteristic features, but on the other hand, since its constitutional threads form a loop and are projected on the kitted fabric surface, there is involved a defect that it is easy to generate snagging as compared with a woven fabric.

In order to improve such a defect of the knitted fabric, there have hitherto been made various investigations. For example, for the purpose of enhancing the force of constraint of a thread appearing on the knitted fabric surface, there are known a method for twisting a thread constituting a kitted fabric (see, for example, Patent Document 1); a method for increasing the density of a knitted fabric (see, for example, Patent Document 2); a method for solidifying the fabric surface with a finishing agent; and the like.

However, the knitted fabrics obtained by the foregoing methods involved a problem that soft touch and stretchability which are original characteristic features of the knitted fabric are impaired.

It is described in Patent Document 3 that a low-torque composite yarn is obtained by imparting interlaces to a doubling of a false-twist crimped yarn having S-direction torque and a false-twist crimped yarn having Z-direction torque.

[Patent Document 1] JP-A-2002-30548

[Patent Document 2] JP-A-2003-247149

[Patent Document 3] Japanese Patent No. 3749549

DISCLOSURE OF THE INVENTION

An object of this invention is to provide a knitted fabric having excellent snagging resistance without impairing soft touch and stretchability and sports clothing comprising using such a knitted fabric. The foregoing object can be achieved by a knitted fabric and sports clothing of this invention.

The knitted fabric of this invention is a knitted fabric comprising a composite yarn, which is characterized in that the composite yarn is constituted of two or more kinds of false-twist crimped yarns and has a torque of not more than 30 T/m.

Here, it is preferable that the composite yarn is constituted of a false-twist crimped yarn having S-direction torque and a false-twist crimped yarn having Z-direction torque. It is preferable that the composite yarn is an interlace-processed interlaced yarn. It is preferable that the torque of the composite yarn is non-torque. It is preferable that a percentage of crimp of the composite yarn is 2% or more. In the composite yarn, it is preferable that a single yarn fineness is not more than 4 dtex. It is preferable that the composite yarn comprises a polyester fiber. It is preferable that 0.1% by weight or more of an ultraviolet ray absorbent is contained in such a polyester fiber. On that occasion, in the knitted fabric, it is preferable that an ultraviolet ray shielding rate at a wavelength in the range of from 280 to 400 nm is 90% or more. It is preferable that 0.2% by weight or more of a matting agent is contained in the polyester fiber. On that occasion, in the knitted fabric, it is preferable that a visible light shielding rate at a wavelength in the range of from 400 to 700 nm is 60% or more.

In the knitted fabric of this invention, it is preferable that a stitch density falls within the range of from 30 to 90 courses/2.54 cm and the range of from 30 to 90 wales/2.54 cm. It is preferable that the knitted fabric has a multilayered structure having at least a surface layer and a back layer and that the composite yarn is disposed on the surface layer. It is preferable that the knitted fabric has a round knitted fabric texture. In the knitted fabric of this invention, it is preferable that a stretchability in a lateral direction as measured according to JIS L1018 is 50% or more. It is preferable that a recovery factor of stretchability in a lateral direction as measured according to JIS L1018 is 90% or more. It is preferable that a snagging resistance as tested for 15 hours by using a hacksaw according to JIS L1058 D-3 Method is grade 3 or more.

The sports clothing of this invention is sports clothing comprising using the foregoing knitted fabric.

BRIEF DESCRIPTION OF THE DRAWING

FIG. 1 is an explanatory view to show an embodiment of a cross-sectional shape of a single fiber which can be employed in the knitted fabric of this invention.

BEST MODES FOR CARRYING OUT THE INVENTION

The composite yarn which is comprised in the knitted fabric of this invention is constituted of two or more kinds of false-twist crimped yarns which are different from each other with respect to a manufacture condition or fineness. A false-twist crimped yarn includes a so-called one-heater false-twist crimped yarn obtained by setting false twisting in a first heater zone and a so-called second-heater false-twist crimped yarn in which the torque is reduced by further introducing the subject yarn into a second heater zone and heat treating it in a relaxed state. Also, it includes a false-twist crimped yarn having S-direction torque and a false-twist crimped yarn having Z-direction torque depending upon the direction of twisting. In this invention, these false-twist crimped yarns can be used. In particular, it is preferred to constitute a composite yarn by a false-twist crimped yarn having S-direction torque and a false-twist crimped yarn having Z-direction torque because a low-torque composite yarn is obtained.

The composite yarn can be, for example, manufactured by the following method. That is, a one-heater false-twist crimped yarn may be obtained by twisting a thread by a twisting apparatus via a first roller and a heat treatment heater having a setting temperature of from 90 to 220° C. (more preferably from 100 to 190° C.); and if desired, a second-heater false-twist crimped yarn may be obtained by further introducing them into a second heater zone and heat treating them in a relaxed state. A stretch ratio at the false twisting processing is preferably in the range of from 0.8 to 1.5; and with respect to the count of false twists, $\alpha$ in an expression: [count of twists (T/m)]=$(32500/(\text{Dtex})^{1/2})\times\alpha$ is preferable from 0.5 to 1.5, and usually from about 0.8 to 1.2. Here, Dtex represents a total fineness of the thread. As the twisting apparatus to be used, a disc type or belt type friction twisting apparatus is suitable because thread guarding is easy and thread breakage is less, and a pin type twisting apparatus may also be employed. The torque which the false-twist crimped yarn has can be chosen in either the S-direction or the Z-direction depending upon the direction of twisting. Next, the foregoing composite yarn is obtained by doubling the two or more kinds of false-twist crimped yarns.

It is preferable that interlaces are imparted to such a composite yarn by interlace processing. In order that soft touch or stretchability may not be impaired, the number of interlaces falls within the range of from 30 to 90 nodes/m. When the subject number of interlaces is larger than 90 nodes/m, there may be a possibility that soft touch or stretchability is impaired. Conversely, when the subject number of interlaces is smaller than 30 nodes/m, there may be a possibility that bundling properties of the composite yarn is insufficient and that knitting properties are impaired. The interlace treatment (interlace processing) may be a treatment using usual interlace nozzles.

It is important that the thus-obtained composite yarn has a torque of not more than 30 T/m (preferably not more than 10 T/m, and especially preferably non-torque (0 T/m)). By constituting a knitted fabric by using such a low-torque composite yarn, excellent snagging resistance is obtained without imparting soft touch and stretchability. It is preferable that the torque is low as far as possible, and non-torque (0 T/m) is the most preferable. In order to attain such non-torque, in doubling a false-twist crimped yarn having S-direction torque and a false-twist crimped yarn having Z-direction torque, it is suitable to use two kinds of false-twist crimped yarns having the same torque except that the torque direction is different.

In the composite yarn, it is preferable that a percentage of crimp is 2% or more (more preferably from 10 to 20%). When the subject percentage of crimp is less than 2%, there may be a possibility that sufficient soft touch and stretchability are not obtained.

In the composite yarn, it is preferable that a single yarn fineness is not more than 4 dtex (preferably from 0.00002 to 2.0 dtex, and especially preferably from 0.1 to 2.0 dtex). It is suitable that the subject single yarn fineness is small as far as possible, and a composite yarn having a single yarn fiber size of not more than 1,000 nm which is called as a "nanofiber" may also be used. When the subject single yarn fineness is larger than 4 dtex, there may be a possibility that soft touch is not obtained. It is preferable that a total fineness of the composite yarn falls within the range of from 33 to 220 dtex. In addition, it is preferable that the number of filaments of the composite yarn falls within the range of from 50 to 300 (more preferably from 100 to 300).

The cross-sectional shape of the single yarn of the composite yarn may be a usual round cross-section or may be a modified cross-section other than a round cross-section. Examples of such a modified cross-section include a triangle, a square, a cross shape, a flat shape, a flat shape with a narrow part, an H type, and a W type. By employing such a modified cross-sectional shape, it is possible to impart water absorbability to the knitted fabric. In particular, by employing a flat modified cross-sectional shape with a narrow part shown in FIG. 1, it is possible to impart not only water absorbability but especially excellent softness to the knitted fabric. On that occasion, it is preferable from the standpoint of softness of the knitted fabric that a degree of flatness of the cross-section represented by a ratio B/C1 of a length B of the flat cross-sectional shape in a longitudinal center line direction to a maximum width C1 in a direction intersected with this longitudinal center line direction at right angles falls within the range of from 2 to 6 (more preferably from 3.1 to 5.0). It is preferable from the standpoint of water absorbability of the knitted fabric that a ratio C1/C2 of the maximum value C1 of the width to a minimum value C2 thereof falls within the range of from 1.05 to 4.00 (more preferably from 1.1 to 1.5).

The fiber which constitutes the composite yarn is not particularly limited; and polyester fibers, acrylic fibers, nylon fibers, rayon fibers, acetate fibers, and besides, natural fibers such as cotton, wool, and silk and composites thereof are useful. Especially, polyester fibers are preferable. As such a polyester, polyesters comprising terephthalic acid as a major acid component and at least one member selected from alkylene glycols having from 2 to 6 carbon atoms, namely ethylene glycol, trimethylene glycol, tetramethylene glycol, pentamethylene glycol, and hexamethylene glycol, as a major glycol component are preferable. Of these, a polyester comprising ethylene glycol as a major glycol component (polyethylene terephthalate) or a polyester comprising trimethylene glycol as a major glycol component (polytrimethylene terephthalate) is especially preferable.

If desired, such a polyester may contain a small amount (usually not more than 30% by mole) of a copolymerization component. On that occasion, examples of a bifunctional carboxylic acid other than terephthalic acid which is used include aromatic, aliphatic or alicyclic bifunctional carboxylic acids such as isophthalic acid, naphthalenedicarboxylic acid, diphenyldicarboxylic acid, diphenoxyethanedicarboxylic acid, β-hydroxyethoxybenzoic acid, p-hydroxybenzoic acid, 5-sodiumsulfoisophthalic acid, adipic acid, sebacic acid, and 1,4-cyclohexanedicarboxylic acid. Examples of a diol compound other than the foregoing glycols include aliphatic, alicyclic or aromatic diol compounds and polyoxyalkylene glycols such as cyclohexane-1,4-dimethanol, neopentyl glycol, bisphenol A, and bisphenol S.

The polyester may be one synthesized by an arbitrary method. For example, when the case of polyethylene terephthalate is explained, the polyethylene terephthalate may be one manufactured by first stage reaction for performing ester exchange reaction of a lower alkyl ester of terephthalic acid such as dimethyl terephthalate and ethylene glycol or reaction of terephthalic acid and ethylene oxide to form a glycol ester of terephthalic acid and/or an oligomer thereof; and a second stage reaction for heating the reaction product of the first stage in vacuo to achieve polycondensation reaction until a desired degree of polymerization is attained. The polyester may also be a polyester obtained through material recycling or chemical recycling, or a polyester obtained by using a catalyst containing specified phosphorus compound and titanium compound as described in JP-A-2004-270097 and JP-A-2004-211268. Furthermore, the polyester may be a biodegradable polyester such as polylactic acid and stereocomplex polylactic acid.

When the polyester contains an ultraviolet ray absorbent in a ratio of 0.1% by weight or more (preferably from 0.1 to 5.0% by weight) relative to the weight of the polyester, ultraviolet ray shielding properties are imparted to the knitted fabric, and such is preferable. Examples of such an ultraviolet ray absorbent include benzoxazine based organic ultraviolet ray absorbents, benzophenone based organic ultraviolet ray absorbents, benzotriazole based organic ultraviolet ray absorbents, and salicylic acid based organic ultraviolet ray absorbents. Of these, benzoxazine based organic ultraviolet ray absorbents are especially preferable from the standpoint of the matter that they are not decomposed at the spinning stage.

As such a benzoxazine based organic ultraviolet ray absorbent, those disclosed in JP-A-62-11744 are suitably enumerated. That is, examples include 2-methyl-3,1-benzoxazin-4-one, 2-butyl-3,1-benzoxazin-4-one, 2-phenyl-3,1-benzoxazin-4-one, 2,2'-ethylenebis(3,1-benzoxazin-4-one), 2,2'-tetramethylenebis(3,1-benzoxazin-4-one), 2,2'-p-phenylenebis(3,1-benzoxazin-4-one), 1,3,5-tri-(3,1-benzoxazin-4-on-2-yl)benzene, and 1,3,5-tri(3,1-benzoxazin-4-on-2-yl) naphthalene.

When the polyester contains a matting agent (for example, titanium dioxide) in a ratio of 0.2% by weight or more (preferably from 0.3 to 2.0% by weight) relative to the weight of the polyester, opaqueness is imparted to the knitted fabric, and such is preferable.

If desired, the polyester may contain at least one member of a fine pore forming agent (for example, an organic sulfonic acid metal salt), a coloration-preventing agent, a heat stabilizer, a flame retarder (for example, diantimony trioxide), a fluorescent brightener, a coloring pigment, an antistatic agent (for example, a sulfonic acid metal salt), a hygroscopic acid (for example, a polyoxyalkylene glycol), an antibacterial agent, and other inorganic particles.

The knitted fabric of this invention comprises the foregoing composite yarn. Here, it is preferable that the composite yarn is contained in an amount of 70% by weight or more (especially preferably 100% by weight) relative to the whole weight of the knitted fabric.

In order to obtain soft touch, a density of the knitted fabric falls within the range of from 30 to 90 courses/2.54 cm and the range of from 30 to 90 wales/2.54 cm. When the density of the knitted fabric exceeds such a range, there may be a possibility that soft touch is not obtained.

In the knitted fabric of this invention, the texture of the knitted fabric is not particularly limited and may be a round knit fabric or may be a weft knit fabric or a warp knit fabric. Suitable examples of the round knit fabric and weft knit texture include sheeting, plain weave, rib stitch, interlock stitch, purl stitch, tuck stitch, float stitch, half cardigan stitch, lace stitch, plated stitch, knit-miss, and one-sided connection. Examples of the warp knit texture include single denbigh stitch, single atlas stitch, double cord stitch, half tricot stitch, fleecy stitch, and jacquard stitch. Of these, round knit fabrics are especially preferable from the standpoint of stretchability. With respect to the number of layers, a single layer or multiple layers of two or more layers may be employed. It is preferable that the knitted fabric has a multilayered structure having at least a surface layer (outside air side) and a back layer (body side) and that the foregoing composite yarn is disposed on the surface layer. By disposing the composite yarn on the surface layer, excellent snagging resistance is obtained.

The knitted fabric of this invention can be easily knitted by using the foregoing composite yarn and using a usual knitting machine. So far as the object of this invention is not impaired, dyeing finishing processing, water absorbing processing, water-repellent processing, napping processing, ultraviolet ray shielding, or processing of every kind for imparting a function such as an antibacterial agent, a deodorant, an insect repellant, a luminous agent, a retroreflective agent, and a minus ion generator may be additionally applied to the knitted fabric of this invention in a usual way. Here, with respect to the water absorbing processing, it is preferred to subject the knitted fabric to one-bath processing with a hydrophilizing agent such as polyethylene glycol diacrylate or derivatives thereof and a polyethylene terephthalate/polyethylene glycol copolymer at dyeing or to impart the hydrophilizing agent to the knitted fabric in a final setting step. It is preferable that the amount of deposition of such a hydrophilizing agent falls within the range of from 0.25 to 0.50% by weight relative to the weight of the knitted fabric.

In the knitted fabric of this invention, since the foregoing low-torque composite yarn is disposed, the knitted fabric surface is flat, loops per se of the knitted fabric are hardly caught, and excellent snagging resistance is obtained. It is preferable that the snagging resistance as tested for 15 hours by using a hacksaw according to JIS L1058 D-3 Method is grade 3 or more.

At the same time, the knitted fabric of this invention presents soft touch and stretchability due to the foregoing composite yarn. It is preferable that the stretchability in a lateral direction as measured according to JIS L1018 is 50% or more (preferably from 80 to 130%). It is also preferable that a recovery factor of stretchability in a lateral direction as measured according to JIS L1018 is 90% or more.

In the case where a polyester fiber comprising an ultraviolet ray absorbent-containing polyester is contained in the knitted fabric of this invention, the knitted fabric presents ultraviolet ray shielding properties. On that occasion, with respect to such ultraviolet ray shielding properties, it is preferable that an ultraviolet ray shielding rate at a wavelength in the range of from 280 to 400 nm is 90% or more (more preferably from 95 to 100%).

In the case where a polyester fiber comprising a matting agent-containing polyester is contained in the knitted fabric of this invention, the knitted fabric presents opaqueness. On that occasion, it is preferable that a visible light shielding rate at a wavelength in the range of from 400 to 700 nm is 60% ore more (more preferably from 65 to 80%).

Next, the sports clothing of this invention is one comprising using the foregoing knitted fabric. Since such sports clothing uses the foregoing knitted fabric, it is excellent in excellent snagging resistance without impairing soft touch and stretchability.

EXAMPLES

Next, Examples and Comparative Examples of this invention are described in detail, but it should not be construed that this invention is limited thereto. The respective measurement items in the Examples were measured in the following methods.

(1) Torque:

A sample (crimped yarn) of about 70 cm is laterally tensioned, an initial load of 0.18 mN×nominal tex (2 mg/de) is hung in a center portion thereof, and both ends thereof are then put together.

Although the yarn starts to rotate by residual torque, it is kept in that state until the initial load stands still, thereby obtaining a twisted yarn. The thus-obtained twisted yarn is measured for the count of twists per a length of 25 cm under a load of 17.64 mN×nominal tex (0.2 g/de) by using a twist counter. The resulting count of twists (T/25 cm) is multiplied by four to calculate the torque (T/m).

(2) Degree of Interlace:

An interlaced yarn is taken by a length of 1 m under a load of 8.82 mN×nominal tex (0.1 g/de), and after removing the load, the yarn is allowed to contract at room temperature for 24 hours, followed by reading the number of nodes, a value of which is indicated in terms of nodes/m.

(3) Snagging Resistance:

The snagging resistance is evaluated by using a hacksaw (for 15 hours) according to JIS L1058 D-3 Method.

(4) Percentage of Crimp:

A test thread is wound around a sizing reel having a peripheral length of 1.125 m, thereby preparing a hank having a dry fineness of 3,333 dtex. When the hank is suspended by a suspending pin of a scale board, an initial load of 6 g is applied in a lower portion thereof, and a load of 600 g is further applied, a length L0 of the hank is measured. Immediately thereafter, the load is removed from the hank, and the hank is removed from the suspending pin of the scale board and then dipped in boiling water for 30 minutes, thereby revealing crimp. The hank after the boiling water treatment is taken out from boiling water and after removing the moisture contained in the hank by absorbing on a filter paper, is air-dried at room temperature for 24 hours. The air-dried hank is suspended by a suspending pin of a scale board; a load of 600 g is applied in a lower portion thereof; one minute thereafter, a length L1a of the hank is measured; the load is then removed from the hank; and one minute thereafter, a length L2a of the hank is measured. A percentage of crimp (CP) of the test filament thread is calculated according to the following expression.

$$CP(\%)=((L1a-L2a)/L0)\times 100$$

(5) Stretchability:

The stretchability (%) is measured according to according to JIS L1018.

(6) Recovery factor of Stretchability:

The recovery factor of stretchability (%) is measured according to JIS L1018.

(7) Touch:

The touch is evaluated on four grades of "especially soft", "soft", "moderate" and "hard" by means of organoleptic evaluation by three panelists.

(8) Ultraviolet Ray Shielding Rate:

The ultraviolet ray shielding rate at a wavelength in the range of from 280 to 400 nm is calculated by using a spectrophotometer MP-3100, manufactured by Shimadzu Corporation.

(9) Visible Light Shielding Rate:

The visible light shielding rate at a wavelength in the range of from 400 to 700 nm is calculated as a substitute characteristic of opaqueness by using a spectrophotometer MP-3100, manufactured by Shimadzu Corporation.

(9) Content of Matting Agent:

The content of matting agent is calculated according to the following expression.

$$[\text{Content of matting agent } (\%)]=[\text{Mass of matting agent to be added } (gr)]/[\text{Mass of polymer before addition of matting agent } (gr)]\times 100$$

Example 1

Usual polyethylene terephthalate (content of matting agent: 0.3% by weight) was melt spun at 280° C. from a usual spinning apparatus, withdrawn at a rate of 2,800 m/min and wound up without being stretched, thereby obtaining a semi-stretched polyester thread of 145 dtex/72 fil (cross-sectional shape of single yarn fiber: round cross-section).

Next, the polyester thread was subjected to simultaneous stretch and false-twist crimp processing under a condition at a stretch ratio of 1.6 times, the count of false twists of 2,500 T/m (S-direction), a heater temperature of 180° C. and a yarn speed of 350 m/min.

Also, the subject polyester thread was subjected to simultaneous stretch and false-twist crimp processing under a condition at a stretch ratio of 1.6 times, the count of false twists of 2,500 T/m (Z-direction), a heater temperature of 180° C. and a yarn speed of 350 m/min.

Next, these false-twist crimped yarn having S-direction torque and false-twist crimped yarn having Z-direction torque were doubled and subjected to air interlace treatment, thereby obtaining a composite yarn (167 dtex/144 fil, percentage of crimp: 12%, torque: 0 T/m). On that occasion, the air interlace treatment was interlace processing using interlace nozzles, and 50 interlaces per meter were imparted at an overfeed rate of 1.0% under a pressurized air pressure of 0.3 MPa (3 kgf/cm$^2$).

Next, a round knitted fabric of a sheeting texture was formed by using the subject composite yarn and using a 28G single circular knitting machine. Then, the subject knitted fabric was subjected to usual dyeing finishing processing and to water absorbing processing in a final setting step. With respect to the water absorbing processing, a hydrophilizing agent (polyethylene terephthalate/polyethylene glycol copolymer) was deposited on the knitted fabric in an amount of 0.30% by weight relative to the weight of the knitted fabric.

The thus-obtained knitted fabric had a basis weight of 135 g/m$^2$, 43 courses/2.54 cm, 41 wales/2.54 cm, snagging resistance of grade 3 to grade 4, lateral stretchability of 85%, a recovery factor of stretchability in a lateral direction of 95% and "soft" touch and was excellent in soft touch, stretchability and snagging resistance. Also, the subject knitted fabric had a visible light shielding rate at a wavelength in the range of from 400 to 700 nm of 68% and was excellent in opaqueness.

Also, as a result of sewing a T-shirt (sports clothing) by using such a knitted fabric and wearing it, it was excellent in soft touch, stretchability and snagging resistance.

Example 2

In Example 1, a composite yarn (167 dtex/144 fil, percentage of crimp: 8%, torque: 10 T/m) was obtained by changing only the count of false twists of Z-direction false-twist to 1,800 T/M. Others were the same as in Example 1.

The thus-obtained knitted fabric had a basis weight of 140 g/m$^2$, 50 courses/2.54 cm, 45 wales/2.54 cm, snagging resistance of grade 3 to grade 4, lateral stretchability of 80%, a recovery factor of stretchability in a lateral direction of 92% and "soft" touch and was excellent in soft touch, stretchability and snagging resistance.

Example 3

Usual polyethylene terephthalate (content of matting agent: 0.3% by weight) was melt spun at 280° C. from a usual spinning apparatus, withdrawn at a rate of 2,800 m/min and wound up without being stretched, thereby obtaining a semi-stretched polyester thread of 90 dtex/48 fil (cross-sectional shape of single yarn fiber: round cross-section).

Next, the polyester thread was subjected to simultaneous stretch and false-twist crimp processing under a condition at a stretch ratio of 1.6 times, the count of false twists of 2,500 T/m (S-direction), a heater temperature of 180° C. and a yarn speed of 350 m/min.

Also, the subject polyester thread was subjected to simultaneous stretch and false-twist crimp processing under a condition at a stretch ratio of 1.6 times, the count of false twists of 2,500 T/m (Z-direction), a heater temperature of 180° C. and a yarn speed of 350 m/min.

Next, these false-twist crimped yarn having S-direction torque and false-twist crimped yarn having Z-direction torque were doubled and subjected to air interlace treatment, thereby obtaining a composite yarn (110 dtex/96 fil, percentage of crimp: 7%, torque: 0 T/m). The air interlace treatment was carried out by using interlace nozzles, and 60 interlaces per meter were imparted at an overfeed rate of 1.0% under a pressurized air pressure of 0.3 MPa (3 kgf/cm$^2$) Next, a round knitted fabric of a one-sided connection texture was formed by using the subject composite yarn as a front-sided thread while using a false-twist crimped yarn (56 dtex/72 fil, percentage of crimp: 13%, torque: 40 T/m) comprising polyethylene terephthalate (content of matting agent: 0.3% by weight) as a back-sided thread and using a 28G double circular knitting machine. Then, the subject knitted fabric was subjected to usual dyeing finishing processing and to water absorbing processing in a final setting step in the same manner as in Example 1.

The thus-obtained knitted fabric had a basis weight of 175 g/m$^2$, 43 courses/2.54 cm, 32 wales/2.54 cm, snagging resistance of grade 4, lateral stretchability of 90%, a recovery factor of stretchability in a lateral direction of 96% and "soft" touch and was excellent in soft touch, stretchability and snagging resistance.

Example 4

The same procedures as in Example 1 were followed, except that in Example 1, a 2,2'-p-phenylenebis(3,1-benzoxazin-4-one) organic based ultraviolet ray absorbent was contained in polyethylene terephthalate in an amount of 1.0% by weight relative to the weight of polyethylene terephthalate. The obtained knitted fabric had an ultraviolet ray shielding rate at a wavelength in the range of from 280 to 400 nm of 94% and was excellent in ultraviolet ray shielding properties.

Example 5

The same procedures as in Example 1 were followed, except that in Example 1, the cross-sectional shape of the single yarn fiber was changed to a flat cross-sectional shape as illustrated in FIG. 1 in which three narrow parts per one side were provided, a degree of flatness B/C1 of the cross-section was 3.2, and a ratio C1/C2 was 1.2.

The obtained knitted fabric had "especially soft" touch. Also, the subject knitted fabric was excellent in water absorbability.

Example 6

The same procedures as in Example 1 were followed, except that in Example 1, the cross-sectional shape of the single yarn fiber was changed to a cross-shaped cross-sectional shape.

The obtained knitted fabric had "soft" touch. Also, the subject knitted fabric was excellent in water absorbability.

Example 7

The same procedures as in Example 1 were followed, except that in Example 1, usual polytrimethylene terephthalate (content of matting agent: 0.3% by weight) was used in place of the usual polyethylene terephthalate (content of matting agent: 0.3% by weight).

The obtained knitted fabric had "especially soft" touch.

Comparative Example 1

A round knitted fabric of a sheeting texture was formed by using a false-twist crimped yarn (167 dtex/14 fil, percentage of crimp: 14%, torque: 45 T/m) comprising polyethylene terephthalate and using a 28G single circular knitting machine. Then, the subject knitted fabric was subjected to usual dyeing finishing processing and to water absorbing processing in a final setting step in the same manner as in Example 1.

The thus-obtained knitted fabric had a basis weight of 130 g/m$^2$, 42 courses/2.54 cm, 41 wales/2.54 cm, snagging resistance of grade 2, lateral stretchability of 50%, a recovery factor of stretchability in a lateral direction of 85% and "soft" touch and was inferior in snagging resistance.

Comparative Example 2

A round knitted fabric of a one-sided connection texture was formed by using a false-twist crimped yarn (110 dtex/96 fil, percentage of crimp: 10%, torque: 35 T/m) comprising polyethylene terephthalate as a front-sided thread while using a false-twist crimped yarn (56 dtex/72 fil, percentage of crimp: 13%, torque: 40 T/m) comprising polyethylene terephthalate as a back-sided thread and using a 28G double circular knitting machine. Then, the subject knitted fabric was subjected to usual dyeing finishing processing and to water absorbing processing in a final setting step in the same manner as in Example 1.

The thus-obtained knitted fabric had a basis weight of 130 g/m$^2$, 42 courses/2.54 cm, 41 wales/2.54 cm, snagging resistance of grade 2, lateral stretchability of 55%, a recovery factor of stretchability in a lateral direction of 88% and "soft" touch and was inferior in snagging resistance.

Industrial Applicability

A knitted fabric having excellent snagging resistance without impairing soft touch and stretchability and sports clothing comprising using such a knitted fabric are provided, and these have high practical usefulness.

The invention claimed is:

1. A knitted fabric comprising a composite yarn, which is characterized in that the composite yarn is constituted of two or more kinds of false-twist crimped yarns and has a torque of not more than 30 T/m, the knitted fabric comprises a hydrophilizing agent, a percentage of crimp of the composite yarn is 2% or more, the composite yarn consists of polyethylene terephthalate fiber, and the composite yarn has a single yarn fineness of 0.00002 to 2.0 dtex and the composite yarn is an interlace-processed interlaced yarn wherein the number of interlaces falls within the range of from 50 to 90 nodes/m.

2. The knitted fabric according to claim 1, wherein the composite yarn is constituted of a false-twist crimped yarn having S-direction torque and a false-twist crimped yarn having Z-direction torque.

3. The knitted fabric according to claim 1, wherein the torque of the composite yarn is non-torque.

4. The knitted fabric according to claim 1, wherein 0.1% by weight or more of an ultraviolet ray absorbent is contained in the polyethylene terephthalate fiber.

5. The knitted fabric according to claim 1, wherein a cross-sectional shape of a single yarn fiber of the false-twist crimped yarn is a modified cross-section other than a round cross-section.

6. The knitted fabric according to claim 1, wherein an ultraviolet ray shielding rate at a wavelength in the range of from 280 to 400 nm is 90% or more.

7. The knitted fabric according to claim 1, wherein 0.2% by weight or more of a matting agent is contained in the polyethylene terephthalate fiber.

8. The knitted fabric according to claim 1, wherein a visible light shielding rate at a wavelength in the range of from 400 to 700 nm is 60% or more.

9. The knitted fabric according to claim 1, wherein a stitch density falls within the range of from 30 to 90 courses/2.54 cm and the range of from 30 to 90 wales/2.54 cm.

10. The knitted fabric according to claim 1, wherein the knitted fabric has a multilayered structure having at least a surface layer and a back layer, and the composite yarn is disposed on the surface layer.

11. The knitted fabric according to claim 1, wherein the knitted fabric has a round knitted fabric texture.

12. The knitted fabric according to claim 1, wherein a stretchability in a lateral direction as measured according to JIS L1018 is 50% or more.

13. The knitted fabric according to claim 1, wherein a recovery factor of stretchability in a lateral direction as measured according to JIS L1018 is 90% or more.

14. The knitted fabric according to claim 1, wherein a snagging resistance as tested for 15 hours by using a hacksaw according to JIS L1058 D-3 Method is grade 3 or more.

15. Sports clothing comprising using the knitted fabric according to claim 1.

16. Sports clothing comprising using the knitted fabric according to claim 2.

* * * * *